US009647357B2

(12) United States Patent
Sawairi et al.

(10) Patent No.: US 9,647,357 B2
(45) Date of Patent: May 9, 2017

(54) PEG PRESS-FITTING STRUCTURE FOR CONNECTOR

(71) Applicant: Yazaki Corporation, Minato-ku, Tokyo (JP)

(72) Inventors: Kaoru Sawairi, Makinohara (JP); Keiji Hamada, Utsunomiya (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/297,748

(22) Filed: Oct. 19, 2016

(65) Prior Publication Data

US 2017/0040722 A1 Feb. 9, 2017

Related U.S. Application Data

(63) Continuation of application No. 14/825,323, filed on Aug. 13, 2015, now Pat. No. 9,590,328, which is a (Continued)

(30) Foreign Application Priority Data

Feb. 13, 2013 (JP) ..... 2013-025745

(51) Int. Cl.
*H01R 12/59* (2011.01)
*H01R 12/70* (2011.01)
(Continued)

(52) U.S. Cl.
CPC ..... *H01R 12/7011* (2013.01); *H01R 12/596* (2013.01); *H01R 12/675* (2013.01); *H01R 12/79* (2013.01)

(58) Field of Classification Search
CPC ..... H01R 13/6581; H01R 13/6582; H01R 12/7011; H01R 12/596
See application file for complete search history.

(56) References Cited

U.S. PATENT DOCUMENTS 4,449,165 A 5/1984 Kaufman
5,145,407 A 9/1992 Obata et al.
(Continued)

FOREIGN PATENT DOCUMENTS

JP 51-083793 7/1976
JP H08-512424 A 12/1996
(Continued)

OTHER PUBLICATIONS

May 13, 2014—International Search Report—Intl App PCT/JP2014/053360.
(Continued)

*Primary Examiner* — Briggitte R Hammond
(74) *Attorney, Agent, or Firm* — Banner & Witcoff, Ltd.

(57) ABSTRACT

A peg press-fitting structure for a connector includes a peg which is made from a metal plate to fix a housing of the connector to a circuit board, and which is attached to the housing by being press-fitted from the distal end of the peg into a peg attaching slot of the housing of the connector. The housing is provided with an end wall where an entrance of the peg attaching slot opens. A press-fitting position regulating projection, which regulates the press-fitting position of the peg by abutting against the end wall of the housing where the entrance of the peg attaching slot opens, is provided closer to the base end of the peg than a press-fitted portion of the peg that is press-fitted into the peg attaching slot.

4 Claims, 8 Drawing Sheets

Related U.S. Application Data continuation of application No. PCT/JP2014/053360, filed on Feb. 13, 2014.

(51) Int. Cl.
*H01R 12/67* (2011.01)
*H01R 12/79* (2011.01)

(56) References Cited

U.S. PATENT DOCUMENTS

| | | | |
|---|---|---|---|
| 5,419,713 | A | 5/1995 | Northey |
| 5,422,789 | A | 6/1995 | Fisher et al. |
| 5,632,649 | A | 5/1997 | Spangler |
| 5,704,807 | A | 1/1998 | Sherman et al. |
| 5,971,803 | A | 10/1999 | McHugh et al. |
| 6,030,249 | A | 2/2000 | Illg |
| 6,280,248 | B1 | 8/2001 | Mitra |
| 6,319,026 | B1 | 11/2001 | Chen et al. |
| 6,343,951 | B1 | 2/2002 | Ono et al. |
| 6,471,544 | B1 | 10/2002 | Huang |
| 6,517,252 | B2 | 2/2003 | Yamaguchi |
| 6,638,105 | B1 | 10/2003 | Wu |
| 7,052,317 | B2 | 5/2006 | Hara et al. |
| 7,445,499 | B2 | 11/2008 | Nunokawa et al. |
| 7,581,985 | B2 | 9/2009 | Sakamoto |
| 2002/0081900 | A1 | 6/2002 | Yu et al. |
| 2003/0119366 | A1 | 6/2003 | Wu |

FOREIGN PATENT DOCUMENTS

| | | | |
|---|---|---|---|
| JP | 2000-294324 | A | 10/2000 |
| JP | 2003-168520 | A | 6/2003 |
| JP | 2010-176958 | A | 8/2010 |
| WO | 9424730 | A1 | 10/1994 |

OTHER PUBLICATIONS

Aug. 18, 2015—(WO) IPRP and Written Opinion—App PCT/JP2014/053360.

Nov. 24, 2016—(JP) Notification of Reasons for Refusal—App 2013-025745.

Nov. 14, 2016—(US) Notice of Allowance—U.S. Appl. No. 14/825,323.

PEG PRESS-FITTING STRUCTURE FOR CONNECTOR

CROSS REFERENCE TO RELATED APPLICATIONS

This application is a continuation of U.S. patent application Ser. No. 14/825,323 filed Aug. 13, 2015, which is continuation of PCT application No. PCT/JP2014/053360, which was filed on Feb. 13, 2014 based on Japanese Patent Application (No. 2013-025745) filed on Feb. 13, 2013, the contents of which are incorporated herein by reference.

BACKGROUND OF THE INVENTION

1. Field of the Invention

The present invention relates to a peg press-fitting structure to fix the housing of a connector to a circuit board.

2. Related Art

It is known (for example, refer to JP-A-2010-176958) to use pegs made of metal which can perform the grounding connection of a board side connector at the same time when the board side connector (receptacle) is fixed to a circuit board.

In this case, the pegs made of metal are press-fitted and fixed into peg attaching slots which a connector housing is formed with, and when the pegs are fixed to the circuit board, the pegs are electrically connected to a grounding circuit of the circuit board while the connector is attached to the circuit board.

With such a construction, when a cable side connector is engaged with the board side connector, a grounding connection of the cable side connector can be performed by electrically connecting a grounding member of the cable side connector to the pegs.

The pegs are attached to the connector housing typically by being press-fitted into the peg attaching slots which the connector housing is formed with, and the pegs are positioned by, for example, recognizing that the pegs project from the housing.

However, if the pegs are positioned only by recognizing that the pegs project from the housing, when the pegs are excessively pushed into the peg attaching slots of the housing, the press-fitting positions may become out of the appropriate range.

If the press-fitting positions are displaced like this, there is a problem which is that when the cable side connector is engaged with the board side connector, the contacting positions where the grounding member of the cable side connector and the pegs contact may be displaced, and the reliability of the grounding connection decreases.

The present invention is made in view of the above circumstances, and the object of the present invention is to provide a peg press-fitting structure for connector which can improve the reliability when a grounding connection is performed by appropriately regulating peg press-fitting positions.

SUMMARY OF THE INVENTION

In order to achieve the purpose described above, a peg press-fitting structure for connector according to the invention is characterized by the following (1) to (3).

(1) A peg press-fitting structure for a connector including a peg which is made from a metal plate to fix a housing of the connector to a circuit board, and which is attached to the housing by being press-fitted from the distal end of the peg into a peg attaching slot of the housing of the connector, wherein the housing is provided with an end wall where an entrance of the peg attaching slot opens, and a press-fitting position regulating projection, which regulates the press-fitting position of the peg by abutting against the end wall of the housing where the entrance of the peg attaching slot opens, is provided closer to the base end of the peg than a press-fitted portion of the peg that is press-fitted into the peg attaching slot.

(2) The peg press-fitting structure for the connector of (1), wherein a board of the peg is provided with an obliquely cut-and-raised piece, whose distance from the board increases gradually toward the press-fitting direction of the peg, as the press-fitting position regulating projection, and the distal end of the cut-and-raised piece abuts against the end wall of the housing where the entrance of the peg attaching slot opens.

(3) The peg press-fitting structure for the connector of (1) or (2), wherein the peg is connected to a grounding circuit of the circuit board at the same time by being inserted and fixed into a through hole of the circuit board, and the base end side of the peg is formed as a part which electrically contact a grounding member which a mating side connector is provided with when the connector is engaged with the mating side connector.

According to the peg press-fitting structure of the constitution of the above (1), when the peg to fix the housing of the connector to the circuit board is press-fitted into the peg attaching slot of the housing, since the press-fitting position regulating projection which is provided at the base end side of the peg abuts against the end wall of the housing, the press-fitting position of the peg is regulated. Therefore, the press-fitting position of the peg can be managed appropriately, the contact position where a metal member for grounding electrically contacts the base end side of the peg can be stabilized, and the contact reliability can be improved.

According to the peg press-fitting structure of the constitution of the above (2), because the obliquely cut-and-raised piece is provided as the press-fitting position regulating projection, the press-fitting position of the peg can be definitely regulated with a simple constitution.

According to the peg press-fitting structure of the constitution of the above (3), when the mating side connector is grounded by using the peg, because the grounding member which the mating side connector is provided with could electrically contact the base end side of the peg whose position is appropriately regulated, a grounding connection whose reliability is high can be performed.

According to the present invention, because the press-fitting position regulating projection is provided at the base end side of the peg, the press-fitting position of the peg can be appropriately regulated since the press-fitting position regulating projection abuts against the end wall of the housing when the peg is press-fitted. Therefore, when the mating side connector is grounded through the peg, the contact position where the grounding member of the mating side connector and the peg contact can be stabilized, and the reliability of the grounding connection can be improved.

The present invention has been briefly described above. Further, details of the invention will become more apparent after an embodiment of the invention described below (hereinafter referred to as "embodiments") are read with reference to the accompanying figures.

DETAILED DESCRIPTION OF THE EXEMPLARY EMBODIMENTS

Below, an embodiment of the present invention is described with reference to the figures.

Figure 1:
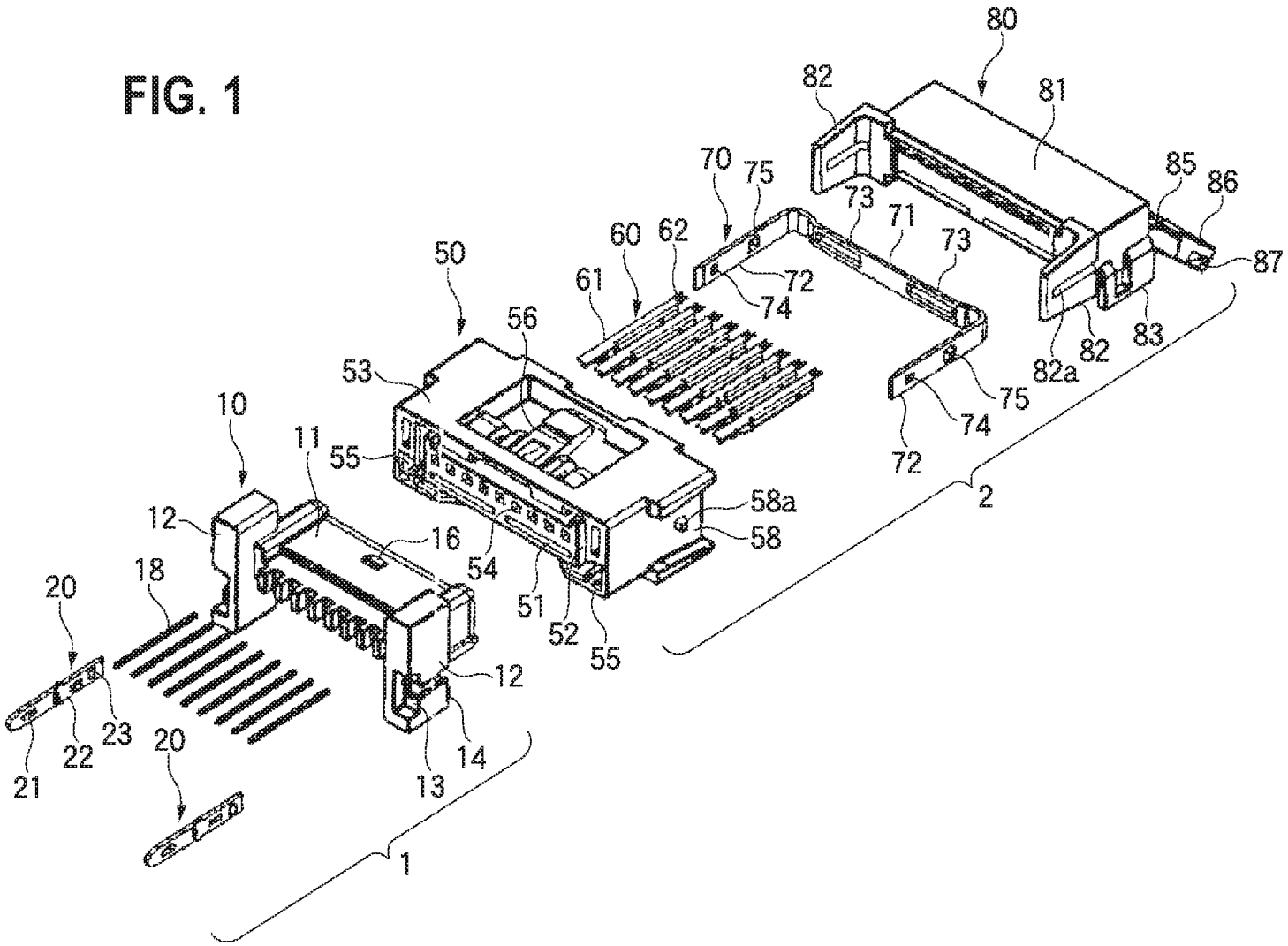
FIG. 1 is an exploded perspective view of a connector device in which a peg press-fitting structure of the embodiment of the present invention is included.
Figure 2:
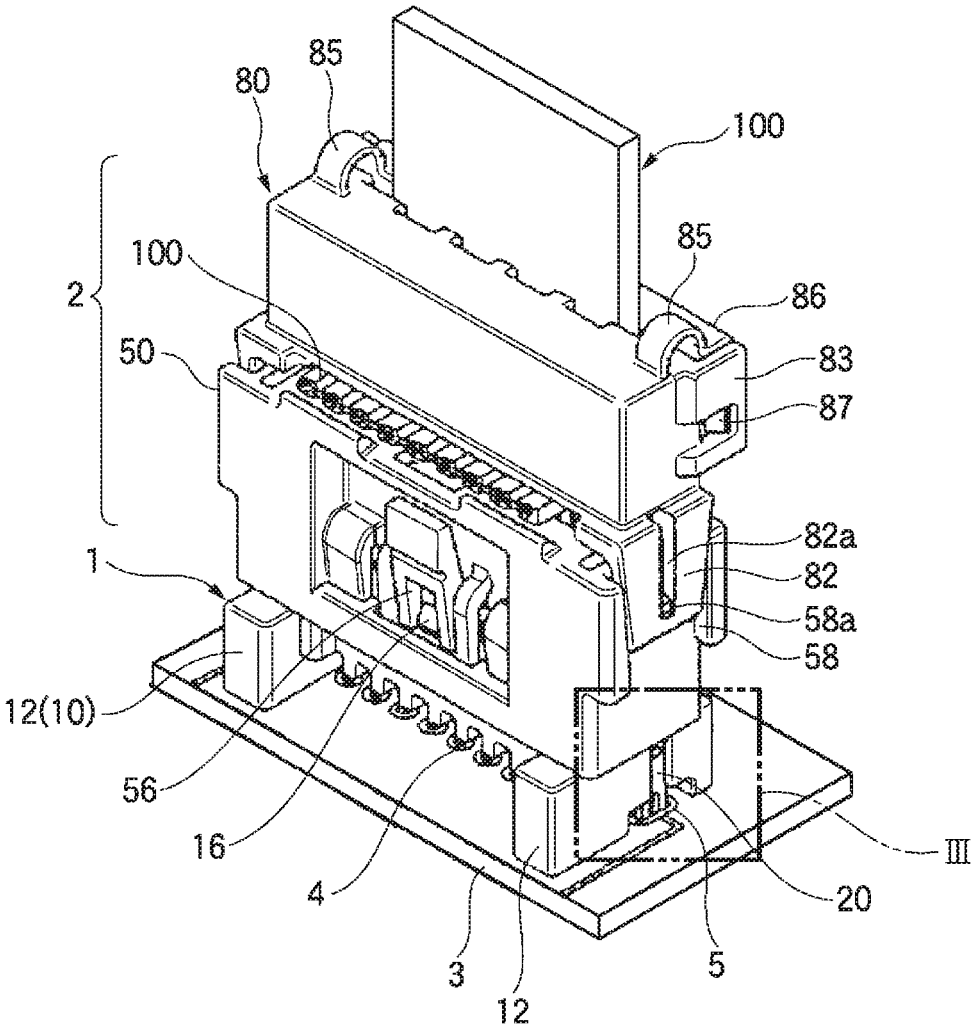
FIG. 2 is a perspective view which indicates that the connector device in which the peg press-fitting structure of the embodiment of the present invention is included is in an engaged state.
Figure 3:
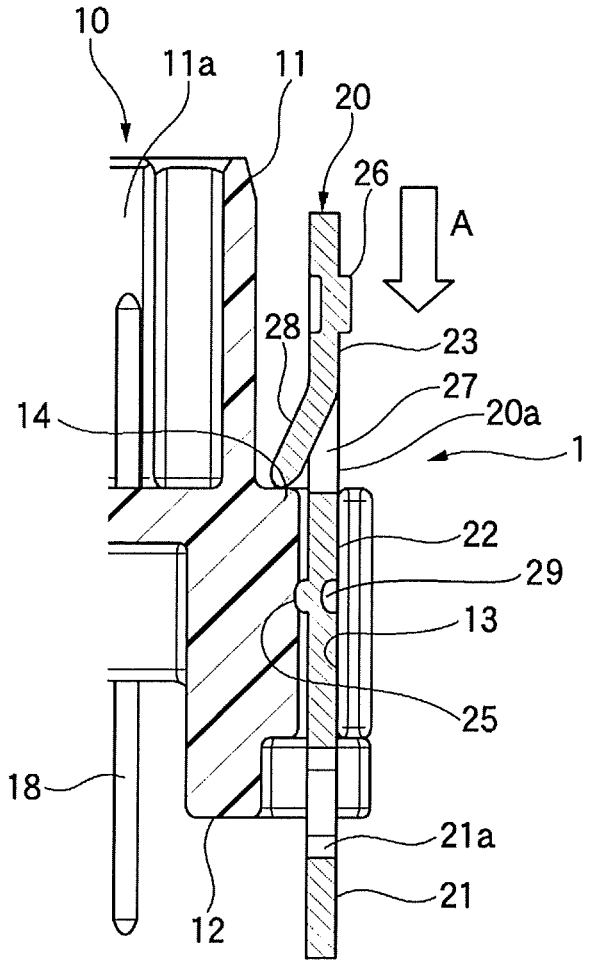
FIG. 3 is an expanded sectional view of part of the peg press-fitting structure of the embodiment that is applied to the III portion of FIG. 2.
Figure 4:
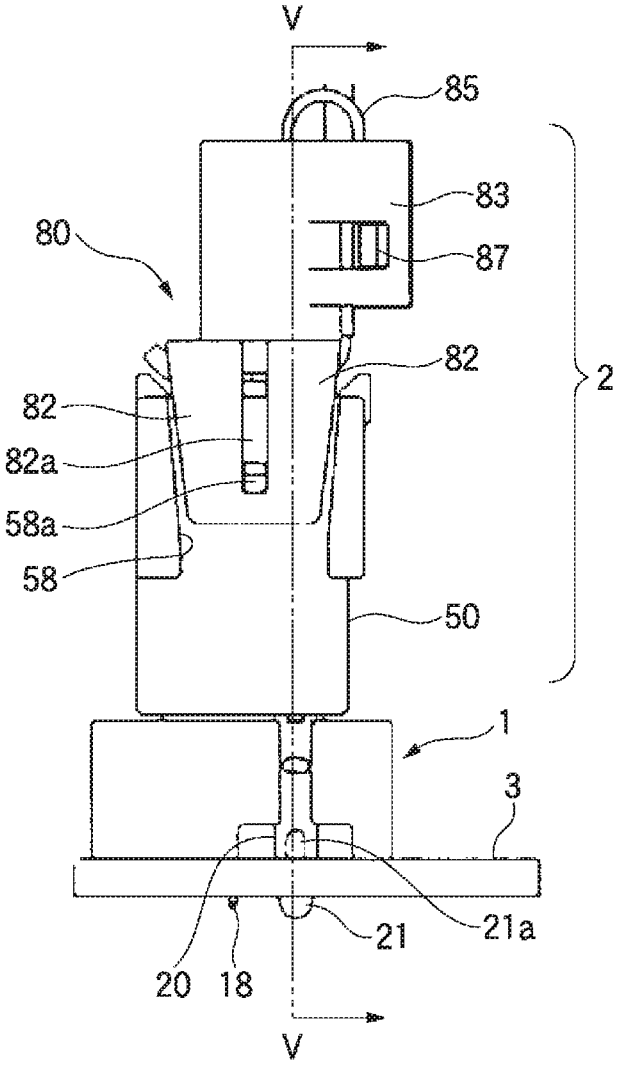
FIG. 4 is a side view which indicates that the connector device in which the peg press-fitting structure of the embodiment of the present invention is included is in the engaged state.
Figure 5:
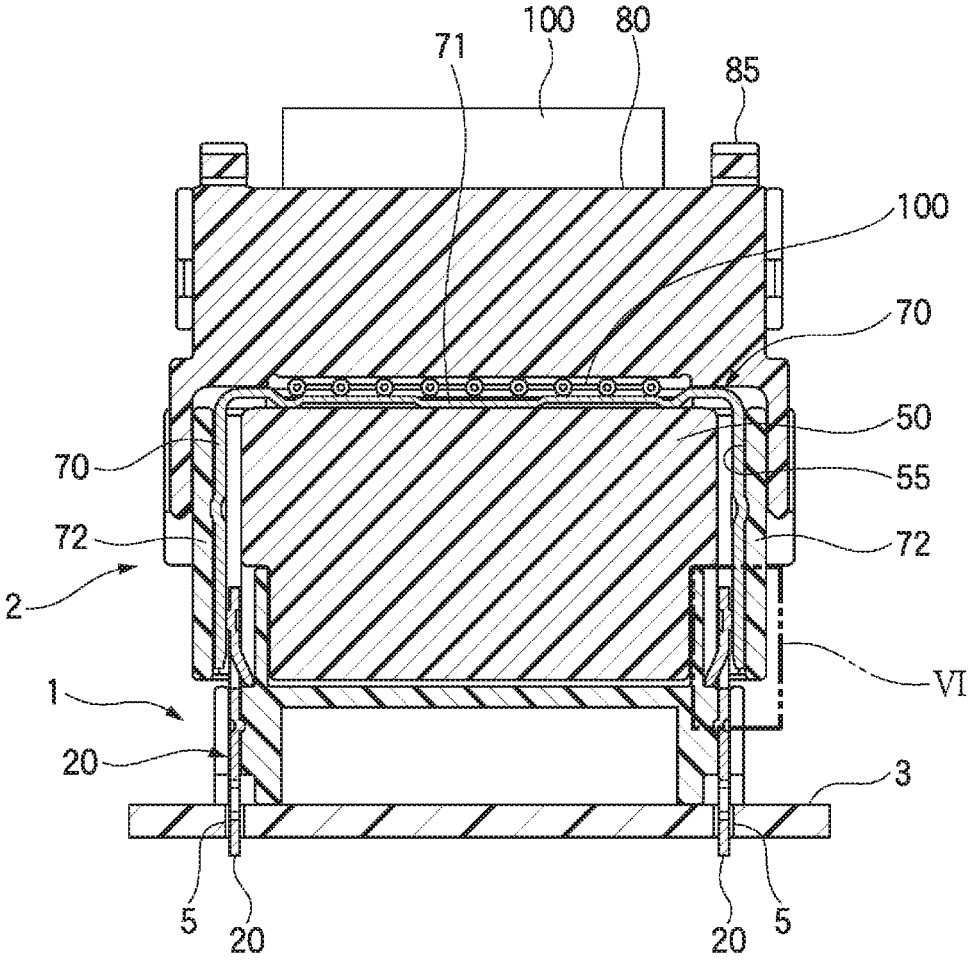
FIG. 5 is a sectional view taken along a line indicated by the V-V arrows of FIG. 4.
Figure 6:
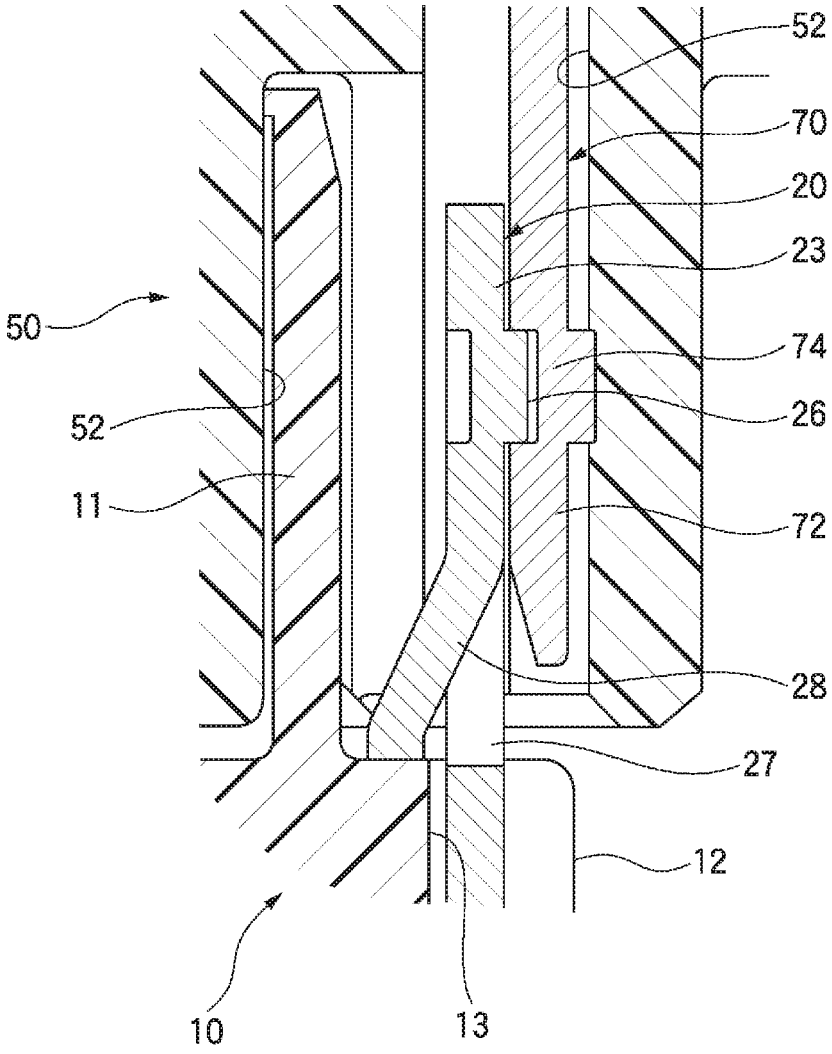
FIG. 6 is an enlarged view of the VI portion of FIG. 5.

FIG. 1 is an exploded perspective view of a connector device in which a peg press-fitting structure of the embodiment of the present invention is included. FIG. 2 is a perspective view which indicates that the connector device in which the peg press-fitting structure of the embodiment of the present invention is included is in an engaged state. FIG. 3 is an expanded sectional view of part of the peg press-fitting structure of the embodiment that is applied to the III portion of FIG. 2. FIG. 4 is a side view which indicates that the connector device in which the peg press-fitting structure of the embodiment of the present invention is included is in the engaged state. FIG. 5 is a sectional view taken along a line indicated by the V-V arrows of FIG. 4. FIG. 6 is an enlarged view of the VI portion of FIG. 5.

As shown in FIGS. 1 and 2, the connector device includes a board side connector (receptacle) 1 and a cable side connector 2 which engage with each other. The board side connector 1 is fixed to a circuit board 3, and the cable side connector 2 is attached to an end of a flat cable 100. By using the connector device, the flat cable 100 can be electrically connected to the circuit board 3.

The board side connector 1 includes a male housing 10 made of resin, a plurality of male terminals 18 which are press-fitted into the male housing 10, and a pair of pegs 20 made of metal plates which are press-fitted and fixed to the male housing 10 to fix the male housing 10 to the circuit board 3. The peg press-fitting structure of the embodiment is applied to the part where these pegs 20 are press-fitted into the male housing 10. As shown in FIG. 2, by being inserted into peg through holes 5 of the circuit board 3 and fixed by soldering, the pegs 20 fix the board side connector 1 to the circuit board 3, and are connected to a grounding circuit of the circuit board 3 at the same time.

The male housing 10 has a housing body 11 which includes an engaging hole 11 a (refer to FIG. 3) into which a female housing 50 of the cable side connector 2 is engaged, and a pair of (right and left) fixing block portions 12 which are integrated at the back end (lower end) side of the male housing 10. When the male terminal 18 is press-fitted into the housing body 11, as shown in FIG. 3, one end side of the male terminal 18 projects into the engaging hole 11*a*, and the other end side of the male terminal 18 projects backward (downward) beyond the back ends (lower ends) of the fixing block portions 12. As shown in FIGS. 1 and 2, a locking projection 16 to lock a locking arm 56 of the female housing 50 when the housing body 11 engages with the female housing 50 of the cable side connector 2 is provided on the outside surface of the housing body 11.

Herein, a front side (upper side) is defined as a side to engage with the cable side connector 2 which is a mating side connector, or a side which is an upper side when the board side connector 1 is fixed to the circuit board 3. Further, a back side (lower side) is defined as a side opposite to the engaging side to engage with the cable side connector 2 which is a counterpart connector, or a side which is a lower side when the board side connector 1 is fixed to the circuit board 3.

Peg attaching slots 13 which extend in the forward/backward direction (upward/downward direction) are formed on the outside surfaces of the right and left fixing block portions 12. These peg attaching slots 13 are equivalent to press-fitting holes where parts of the peripheral walls open, and the pegs 20 are press-fitted from distal end sides 21 to the peg attaching slots 13, as shown with the arrow A from the front side (upper side) to the back side (lower side) in FIG. 3.

The peg 20 includes a flat board 20*a* of a predetermined width from the distal side 21 to a base end side 23, and a middle portion between the distal end side 21 and the base end side 23 becomes a press-fitted portion 22 which is press-fitted and fixed to the peg attaching slot 13.

As shown in FIGS. 2 and 4, the distal end sides 21 of the pegs 20 are parts which are inserted into the peg through holes 5 of the circuit board 3. The distal end sides 21 of the pegs 20 have through holes 21*a* at a height to locate at the circuit board 3 when inserted. The base end sides 23 of the pegs 20 are parts which remain at the outside (the upper side) without entering the peg attaching slots 13 after press-fitted. The outside surfaces of the base end sides 23 of the pegs 20, as shown in FIGS. 5 and 6, are parts which a bus bar plate 70 for grounding which the cable side connector 2 is provided with contacts and electrically connects with when the board side connector 1 engages with the cable side connector 2.

As shown in FIG. 3, the press-fitted portion 22 of the peg 20 is provided with a press-fitting salient 25 which, by pressing from one board surface of the board 20*a*, protrudes to the other board surface. The press-fitting salient 25 ensures fixing strength of the press-fitting by cutting into the inner wall of the peg attaching slot 13 at the time of press-fitting, and is provided at the board surface which becomes the inner side when press-fitted. A recess 29 is formed on the surface of the board 20*a* of the peg 20 on the opposite side of the press-fitting salient 25. The outside board surface of the base end side 23 of the peg 20 is provided with a pressing salient 26 to raise contact pressure with the bus bar plate 70 for grounding which the cable side connector 2 is provided with.

The base end side 23 of the peg 20 is provided with a press-fitting position regulating projection 28 to regulate a press-fitting position of the peg 20 by abutting against an end wall 14 of the fixing block portion 12 where the entrance of the peg attaching slot 13 opens at the time of press-fitting. The press-fitting position regulating projection 28 is constituted of a cut-and-raised piece which is formed by cutting a U-shaped cut 27 at the board 20*a* of the peg 20, and obliquely raising a rectangular board part inside the cut 27 so that the distance from the board 20*a* increases gradually toward the press-fitting direction of the peg 20. Since the distal ends of the cut-and-raised pieces (press-fitting position regulating projections 28) abut against the end walls 14 of the fixing block portions 12 where the entrances of the peg attaching slots 13 open, a further pushing is prevented.

On the other hand, the cable side connector 2, as shown in FIG. 1, includes the female housing 50 made of resin, a plurality of female terminals 60 which are inserted into terminal insertion holes 54 of the female housing 50, the bus bar plate 70 which is mounted to the back portion of the female housing 50, and a strain relief 80 which is mounted to the back portion of the female housing 50 from the back side of the bus bar plate 70. In the following explanation of the cable side connector 2, a front side is defined as a side to engage with the board side connector 1, and a back side is defined as a side opposite to the front side.

The female housing 50 has an engaging block portion 51 which is fitted inside the engaging hole 11*a* of the housing body 11 of the board side connector 1, and an exterior hood portion 53 which is provided around the engaging block portion 51, and there are insert slots 52, into which the peripheral walls of the housing body 11 of the male housing 10 are inserted, between the engaging block portion 51 and the exterior hood portion 53. The engaging block portion 51 is formed with the terminal insertion holes 54 into which the female terminals 60 are inserted. The exterior hood portion 53 is provided with the locking arm 56 which maintains an engaging state by locking to the locking projection 16 of the male housing 10 when the male housing 10 engages with the female housing 50 appropriately.

The right and left two sides of the female housing 50 are provided with bus bar attaching slots 55 into which right and left side bars 72 of the bus bar plate 70 are press-fitted. Side plate insertion portions 58, where right and left side plates 82 of the strain relief 80 are inserted, are provided on the outer surfaces of the right and left two sides of the female housing 50. The side plate insertion portions 58 are provided with locking salients 58*a* which lock into locking grooves 82*a* at the sides of the strain relief 80.

The female terminal 60 has an engaging portion 61 to engage with the male terminal at the front side in the insertion direction relative to the terminal insertion hole 54, and has a Y-shaped press-contacting blade 62 which is press-connected to the flat cable 100 at the back side in the insertion direction relative to the terminal insertion hole 54.

The bus bar plate 70 is formed by bending a band plate into a U shape, and has a central bar 71 which is pressed against the back end surface of the female housing 50, and the pair of side bars 72 which extend forward from the right and left two ends of the central bar 71 and are press-fitted from the back side to the bus bar attaching slots 55 of the female housing 50. Contact salients 73 to improve contact conductivity with a shielding member (silver foil or the like) 105 of the flat cable 100 are provided on the back surface of the central bar 71. The side bars 72 are provided with pressing salients 74 to improve contact conductivity with the pegs 20 of the board side connector 1, near the front ends of the side bars 72. The side bars 72 are further provided with press-fitting salients 75 which ensure fixing strength of the press-fitting by cutting into the inner walls of the bus bar attaching slots 55 when the side bars 72 are press-fitted into the bus bar attaching slots 55, behind the pressing salients 74.

The strain relief 80 is intended to prevent a force from being applied to a connection part where the flat cable 100 and the female terminal 60 are press-connected when mounted. The strain relief 80 includes a central strain relief body 81, the pair of right and left side plates 82 which extend forward from the right and left two sides of the central strain relief body 81 and are inserted into the side plate insertion portions 58 of the female housing 50 when the strain relief 80 is mounted to the female housing 50, and a cover 86 which is connected through hinges 85 to the back portion of the strain relief body 81 and pushes the flat cable 100 inside by being incorporated to the strain relief body 81 after connected with the flat cable 100.

The pair of right and left side plates 82 are formed with the locking grooves 82*a* into which the locking salients 58*a* of the female housing 50 are locked when the strain relief 80 is appropriately mounted to the female housing 50. Further, the right and left side surfaces of the strain relief body 81 are provided with locking plates 83 which engage with engaging projections 87 of the cover 86 when the hinges 85 are bent to make the cover 86 incorporated to the strain relief body 81.

Figure 7:
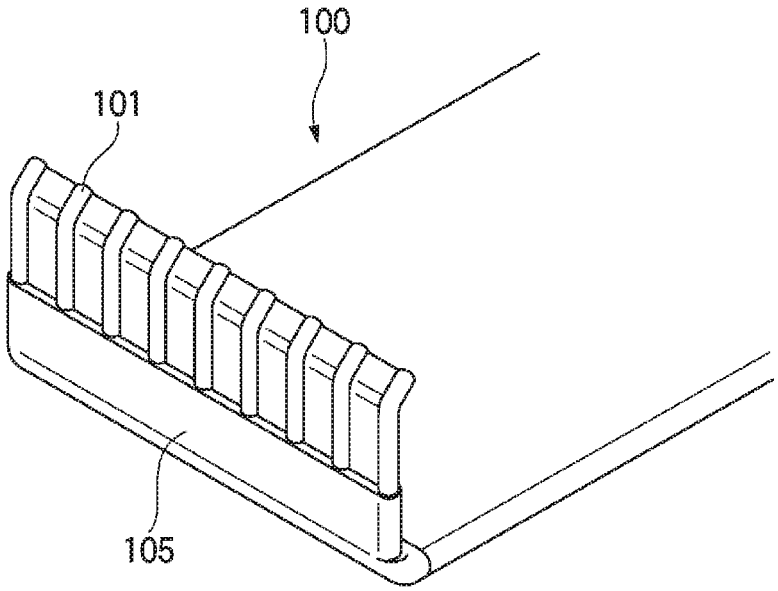
FIG. 7 is a perspective view which indicates the terminal portion of a flat cable that is connected to a circuit board.
Figure 8:
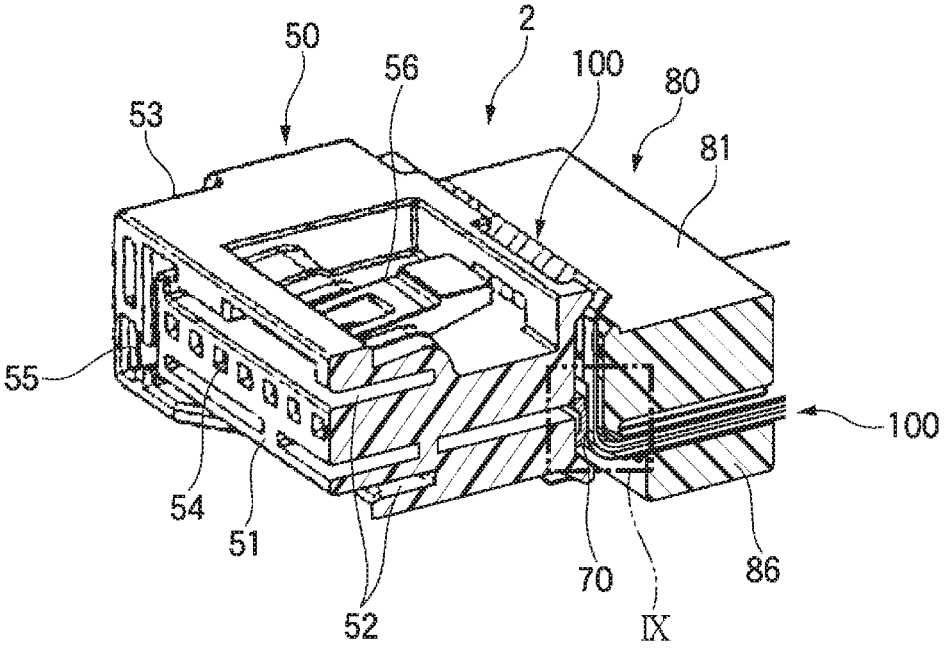
FIG. 8 is the perspective view which indicates a part cross-section of a cable side connector.
Figure 9:
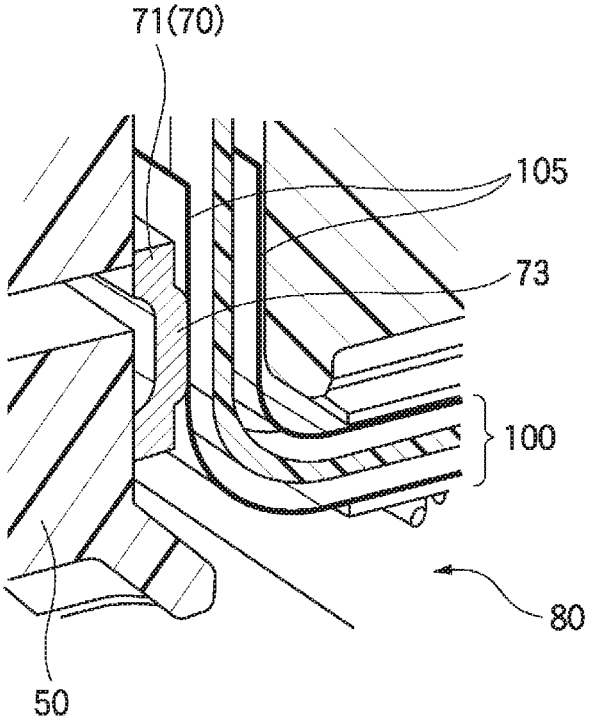
FIG. 9 is an enlarged view of the IX portion of FIG. 8.

The flat cable 100 to which the cable side connector 2 is attached is a flexible flat cable, the periphery of whose insulative coatings under which signal conductors are buried are surrounded with the shielding member 105 such as a silver foil, as shown in FIG. 7. The flat cable 100 has signal lines 101 that are arranged in parallel at predetermined intervals. By making the press-contacting blades 62 provided at the back ends of the female terminals 60 cut into the signal lines 101, the signal conductors inside the signal lines 101 and the female terminals 60 can be press-connected.

Next, a way of assembling the board side connector 1 and the cable side connector 2, and a way of using them are described.

When the board side connector 1 is assembled, first, the male terminals 18 are press-fitted into the male housing 10, and as shown in FIG. 3, the pegs 20 are press-fitted into the peg attaching slots 13 of the male housing 10. When the pegs 20 are press-fitted, because the press-fitting position regulating projections 28 abut against the end walls 14 of the fixing block portions 12, the pegs 20 can be press-fitted to the appropriate positions, and an excessive pushing can be prevented.

When the board side connector 1 constructed in this way is fixed to the circuit board 3, as shown in FIG. 2, the back end surfaces (lower end surfaces) of the fixing block portions 12 of the male housing 10 are placed on the circuit board 3, the projecting ends of the male terminals 18 are inserted into terminal through holes 4, and the distal end sides 21 of the pegs 20 are inserted into the peg through holes 5. In this state, the board side connector 1 can be fixed to the circuit board 3 by soldering, and at the same time, while the male terminals 18 can be connected to the respective circuits, the pegs 20 can be connected to the grounding circuit.

On the other hand, when the cable side connector 2 is assembled, first, the female terminals 60 are inserted into and fixed to (or press-fitted) the terminal insertion holes 54 of the female housing 50. The side bars 72 of the bus bar plate 70 are press-fitted into the bus bar attaching slots 55 which the female housing 50 is formed with. At this time, the female terminals 60 and the bus bar plate 70 are kept contactless.

Then, as shown in FIG. 7, the terminal portion of the flat cable 100 is processed. While the shielding member 105 is peeled only by a suitable length to expose the signal lines 101, the shielding member 105 is exposed at the lower side of the signal lines 101.

Then, the terminal portion of the flat cable 100 is arranged to cover the top of the central bar 71 of the bus bar plate 70 which was previously mounted the back portion of the female housing 50, and from the back side of the terminal portion of the flat cable 100, the strain relief 80 is mounted to the back portion of the female housing 50 while a pressing force is applied. Then, when the strain relief 80 is pressed, the press-contacting blades 62 of the female terminals 60 cut into the positions of the signal lines 101 of the flat cable 100, and the female terminals 60 and the signal conductors which are buried in the signal lines 101 are press-connected.

Then, the hinges 85 are bent to integrate the cover 86 with the strain relief body 81, and the flat cable 100 is sandwiched between the cover 86 and the strain relief body 81. Thereby, an external force from the cable side can be prevented from reaching the press-connected part where the flat cable 100 and the female terminals 60 are press-connected.

Then, when the cable side connector 2 constructed in this way is engaged with the board side connector 1, the flat cable 100 can be electrically connected to the circuit board 3. In this case, as shown in FIGS. 5 and 6, when the side bars 72 of the bus bar plate 70 of the cable side connector 2 slide to electrically contact the outer side surfaces of the base end sides 23 of the pegs 20 of the board side connector 1, the shielding member 105 of the flat cable 100 can be connected to the grounding circuit of the circuit board 3 through the bus bar plate 70 and the pegs 20.

According to the peg press-fitting structure applied to the connector device of the above-mentioned constitution, when the pegs 20 to fix the male housing 10 of the board side connector 1 to the circuit board 3 are press-fitted into the peg attaching slots 13 of the female housing 50, since the press-fitting position regulating projections 28 which are provided at the base end sides 23 of the pegs 20 abut against the end walls 14 of the female housing 50, the press-fitting positions of the pegs 20 can be regulated. Therefore, the press-fitting positions of the pegs 20 can be managed appropriately, the positions of the contacts where the bus bar plate 70 for grounding of the cable side connector 2 electrically contact the base end sides 23 of the peg 20 can be stabilized, and the contact reliability can be improved.

That is, when the cable side connector 2 is grounded by using the pegs 20, because the bus bar plate 70 for grounding which the cable side connector 2 is provided with could electrically contact the base end sides 23 of the pegs 20 whose positions are appropriately regulated, a grounding connection whose reliability is high can be performed.

Further, because the obliquely cut-and-raised pieces are provided as the press-fitting position regulating projections 28, the press-fitting positions of the pegs 20 can be definitely regulated with a simple constitution.

The present invention is not limited to the above described embodiment, and suitable modifications, improvements or the like can be made. Moreover, the materials, shapes, dimensions, numbers, installation places, and the like of the components in the above embodiment are arbitrarily set as far as the invention can be attained, and not particularly restricted.

The features of the embodiment of the peg press-fitting structure for connector according to the present invention described above are briefly, collectively listed in the following [1] to [3], respectively.

[1] A peg press-fitting structure for a connector (board side connector 1) comprising a peg (20) which is made from a metal plate to fix a housing (male housing 10) of the connector to a circuit board (3), and which is attached to the housing by being press-fitted from the distal end of the peg into a peg attaching slot (13) of the housing of the connector, wherein the housing is provided with an end wall (14) where the entrance of the peg attaching slot opens, and a press-fitting position regulating projection (28) which regulates the press-fitting position of the peg by abutting against the end wall is provided closer to the base end of the peg than a press-fitted portion (22) of the peg that is press-fitted into the peg attaching slot.

[2] The peg press-fitting structure for the connector according to the above [1], wherein the press-fitting position regulating projection is an obliquely cut-and-raised piece which a board (20*a*) of the peg is provided with, and whose distance from the board increases gradually toward the press-fitting direction of the peg, and the distal end of the cut-and-raised piece abuts against the end wall.

[3] The peg press-fitting structure for the connector according to the above [1] or [2], wherein the peg is connected to a grounding circuit of the circuit board by being inserted and fixed into a through hole (through hole 5) of the circuit board, and the base end side of the peg is formed as a part which electrically contact a grounding member (bus bar plate 70) which a mating side connector is provided with when the connector is engaged with the mating side connector.

Although the invention is described in detail with reference to the specific embodiment, it is apparent that various modifications and amendments may be made by those skilled in the art without departing from the spirit and scope of the invention.

According to the present invention, when the mating side connector is grounded through the peg, the contact position where the grounding member of the mating side connector and the peg contact can be stabilized, and the reliability of the grounding connection can be improved.

The present invention which has this effect is useful in a peg press-fitting structure to fix a housing of a connector to a circuit board.

What is claimed is:

1. A peg-connector assembly comprising:

a connector;

a grounding member; and a peg having a board made from a metal plate, the peg configured to fix a housing of the connector to a circuit board, the peg being attached to the housing by being press-fitted from a distal end of the peg into a peg attaching slot of the housing of the connector, wherein:

the housing is provided with an end wall where an entrance of the peg attaching slot is formed, a press-fitting position regulating projection comprises an obliquely cut-and-raised piece of the board, the press-fitting position regulating projection configured to regulate the press-fitting position of the peg by abutting against the end wall of the housing where the entrance of the peg attaching slot opens, is provided closer to a base end of the peg than a press-fitted portion of the peg that is press-fitted into the peg attaching slot, the board of the peg comprising an opening extending through an entire thickness of the board, the press-fitting position regulating projection at least partially overlapping the opening in a thickness direction of the board, the connector is disposed on a first side of the board of the peg in the thickness direction and the grounding member is disposed on a second side of the board of the peg in the thickness direction, the first side being opposite to the second side, and the press-fitting position regulating projection being obliquely cut-and-raised away from the grounding member.

2. The peg-connector assembly according to claim 1, wherein a distance between the obliquely cut-and-raised piece and a remainder of the board increases gradually along a press-fitting direction of the peg, and wherein a distal end of the cut-and-raised piece abuts against the end wall of the housing where the entrance of the peg attaching slot is formed.

3. A peg press-fitting structure for a connector comprising:

a peg having a board made from a metal plate, the peg configured to fix a housing of the connector to a circuit board, the peg being attached to the housing by being press-fitted from a distal end of the peg into a peg attaching slot of the housing of the connector, wherein:

the housing is provided with an end wall where an entrance of the peg attached slot is formed, a press-fitting position regulating projection comprises an obliquely cut-and-raised piece of the board, the press-fitting position regulating projection configured to regulate the press-fitting position of the peg by abutting against the end wall of the housing where the entrance of the peg attaching slot opens, is provided closer to a base end of the peg than a press-fitted portion of the peg that is press-fitted into the peg attaching slot, the board of the peg comprising an opening extending through an entire thickness of the board, the press-fitting position regulating projection at least partially overlapping the opening in a thickness direction of the board, and the press-fitted portion of the peg comprises a press-fitting salient that protrudes from a first surface of the board of the peg toward an inner wall of the peg attaching slot to provide the press-fitting of the press-fitted portion, and a corresponding recess on a second surface of the board of the peg, the first surface being opposite to the second surface in the thickness direction.

4. The peg press-fitting structure according to claim 3, wherein the press-fitting position regulating projection is obliquely cut-and-raised in a direction in which the press-fitting salient protrudes.

* * * * *